US005732748A

United States Patent [19]

Aucagne et al.

[11] Patent Number: 5,732,748

[45] Date of Patent: Mar. 31, 1998

[54] COMPOSITE MATERIAL FABRIC BASED ON PREDOMINANTLY UNTWISTED COARSE MULTIFILAMENT WARP & WEFT THREADS

[75] Inventors: Jean Aucagne, La Tour du Pin; Bruno Bompard, Lyons; Alain Bruyere, Villefontaine; Christian Debaille, Sathonay Village; Bertrand Germain, Villeurbanne; Jean-Paul Lamarie, Caluire; Laurent Martinet, Villeurbanne; Franck Perret, Lyons; Jean-François Veauville, Miribel, all of France

[73] Assignee: Brochier S.A., Decines, France

[21] Appl. No.: 446,781

[22] PCT Filed: Nov. 30, 1993

[86] PCT No.: PCT/FR93/01175

§ 371 Date: Jun. 16, 1995

§ 102(e) Date: Jun. 16, 1995

[87] PCT Pub. No.: WO94/12708

PCT Pub. Date: Jun. 9, 1994

[30] Foreign Application Priority Data

Nov. 30, 1992 [FR] France ..... 92 14399

[51] Int. Cl.[6] ..... D03D 15/00; D03D 3/00; D06C 15/02

[52] U.S. Cl. ..... 139/383 R; 139/420 C; 139/420 A; 428/225; 26/99; 100/210; 28/132; 28/140

[58] Field of Search ..... 139/383 R, 420 C, 139/426 R, 420 R, 420 A; 428/225; 26/99; 100/210; 28/137, 132, 140

[56] References Cited

U.S. PATENT DOCUMENTS

| | | | |
|---|---|---|---|
| 2,810,405 | 10/1957 | Huau | 139/420 A |
| 2,887,132 | 5/1959 | Manning et al. . | |
| 3,669,158 | 6/1972 | Phillips | 139/420 R |
| 3,908,808 | 9/1975 | Busker | 100/35 |
| 3,914,494 | 10/1975 | Park | 139/426 R |
| 3,919,028 | 11/1975 | Lewis et al. | 139/426 R |
| 3,955,256 | 5/1976 | Park | 139/420 R |
| 4,906,506 | 3/1990 | Nishimura et al. | 139/383 R |
| 4,932,107 | 6/1990 | Gotoh et al. | 28/137 |
| 5,256,475 | 10/1993 | Koyanagi et al. | 139/420 A |

FOREIGN PATENT DOCUMENTS

| | | | |
|---|---|---|---|
| 538079 | 5/1955 | Belgium . | |
| 0 302 449 | 2/1989 | European Pat. Off. . | |
| 990.557 | 9/1951 | France . | |
| 2 268 895 | 4/1975 | France . | |
| 2 434 880 | 8/1979 | France . | |
| 2478693 | 9/1981 | France | 139/420 A |

*Primary Examiner*—Andy Falik

*Attorney, Agent, or Firm*—Wenderoth, Lind & Ponack

[57] ABSTRACT

A woven fabric to be used in formation of a composite material includes multifilament warp and weft threads. Each of the warp threads and the weft threads have a total weight less than 80% of the weight of the fabric. The woven warp and weft threads have 0 twist/m and a torsion no greater than an original torsion of the threads before weaving. Each woven warp and weft thread has a width over the entire length thereof that is greater than or equal to an original width before weaving. The fabric is woven to have a given weight per unit area and a fiber volume ratio that is approximately constant throughout the fabric and that is satisfactory for use of the fabric in a composite material. The warp and weft threads of a yarn count that is greater than a yarn count traditionally used to achieve the fiber volume ratio for the given weight per unit area.

64 Claims, 5 Drawing Sheets

COMPOSITE MATERIAL FABRIC BASED ON PREDOMINANTLY UNTWISTED COARSE MULTIFILAMENT WARP & WEFT THREADS

BACKGROUND OF THE INVENTION

This invention relates to the field of textile structures intended for the production of composite materials. It more particularly relates to a warp and weft fabric produced, for greater part, from multifilament technical threads with a relatively high yarn count for a relatively low weight per unit area and to a corresponding method for producing the same.

It is known that composite materials have undergone a major expansion, because they combine excellent mechanical properties with low weight. Such materials essentially comprise a textile reinforcement and a resin matrix. Those skilled in the art know that the production of these materials presents some difficulties. In fact, for some uses, in particular in the aeronautical industry, the mechanical properties of the composite materials are strictly defined.

It is often required that the textile structures used in composite materials are sufficiently tightly woven so as to retain a regular geometry and an appropriate handling capacity, while at the same time allowing sufficient penetration of the resin during manufacture of the composite. This enables satisfactory mechanical properties to be obtained in the final composite. It is thus necessary to use sufficiently fine fibers to make such tightly woven structures.

As a function of the desired weight per unit area for the structure, a thread giving perfect covering is chosen, in other words a regular spread which does not leave visible porosities and which, correspondingly, leads to a high volume ratio. It is observed that the lower the weight per unit area of the textile structure, the more the yarn count of the fibers, in other words the linear mass of each fiber, must also be low.

However, fine threads are relatively expensive and this is particularly true for the carbon threads currently available on the market. For example, the price of 1K (1000 filaments) carbon threads is about four times that of 3K threads and six to eight times that of 6K threads. It should be understood that the higher the number of filaments in the threads, the higher the yarn count of the threads.

It is thus advantageous to use coarser threads whose price decreases as the coarseness thereof increases. For example, 6K (6000 filaments) carbon threads, which are twice as coarse as 3K threads, are approximately 30% less expensive. It is the same for 12K threads which are now available on the market and whose price is 30% lower than that of 6K threads.

In order to retain and increase their market share, composite materials must be available at prices lower than those currently in force. In particular in the aeronautical field, it is desirable that the price of a composite component should correspond to that of an aluminum component, which necessitates substantial cost reductions. Since the price of fibers and particularly carbon fibers has a direct effect on the cost of composite components, the choice of the type of fibers is critical.

It is in particular 6K and 12K threads which would enable the costs to be reduced. A fabric from 6K threads is about 30% cheaper than a fabric from 3K threads, for the same weight per unit area. A fabric produced from 12K threads is about 50% cheaper than a fabric of the same weight per unit area produced from 3K threads.

However, if fine threads are replaced by threads of a higher yarn count, while keeping the same weight per unit area, for example replacing four 3K threads with one 12K thread, holes generated in the resulting fabric are proportionately larger than for lower weights per unit area.

Coarser threads are thus unsuited for use in textile structures whose weight per unit area or unit area weight is relatively low, when conventional weaving methods are used. Effectively the structures obtained are too open, and in addition they cannot be easily handled as they leave the weaving loom.

The use of coarser threads is therefore currently limited to fabrics with relatively high weights per unit area. An analysis of the balanced carbon fabrics available on the market, in other words those for which the weight of the warp threads is identical to the weight of the weft threads, and having a uniform surface without porosity, leads to a relation between the thread used and the weight per unit area of the fabric.

For example, 1K threads are used for fabric whose weight per unit area is generally between 90 and 210 g/m$^2$.

Fabrics with a weight per unit area lower than 90 g/m$^2$ can be produced from 1K threads but their porosity is not compatible with the objective of perfect coverage.

With regard to 3K threads, the weight per unit area of fabrics is generally between 180 and 400 g/m$^2$; for 6K threads, it is generally from 260 to 600 g/m$^2$, and lastly for 12K threads it is generally between 465 and 800 g/m$^2$.

The above comment concerning carbon fabrics from 1K threads, relating to the minimum weight of the fabrics, also applies to carbon fabrics obtained from 3K, 6K and 12K threads.

In the textile industry various methods are known for reducing the porosity originally present in a textile structure.

Thus, document FR 2 478 693 discloses a method for reducing the porosity of a preimpregnated fabric, and more particularly an impregnated fabric comprising carbon fibers, without the need for finer fibers.

This method consists of successively forming a fiber from filaments having a relatively circular cross section, weaving the fiber to form a fabric having relatively large interstices, impregnating the fabric with a non-cured resin, engaging a cylinder on one side of the impregnated fabric while supporting the other side of the fabric opposite the cylinder, and moving the cylinder on the fabric a sufficient number of times to obtain a desired flattening of the fibers.

This calendering flattens the fibers so as to reduce the size of the interstices, making it easier for the interstices to be filled when the resin cures and thus reducing the porosity of the finished cured laminate.

However, the production of a dry fabric presents greater difficulties because of the absence of a second material to fill the interstices between the threads.

Nevertheless, within the scope of composite material production, the availability of non-impregnated or dry fabrics is required. This is particularly due to the fact that they can be used very generally, with all types of resin.

EP-0 302 449, discloses a method for reducing the interstices in a fabric. This method was designed for conventional fabrics, produced from fine threads, in particular 3K fibers. It was in fact observed that these fabrics contained porosities which it was necessary to reduce in order to obtain a uniform distribution of the fibers and the resin in the final composite.

Such method does not teach the use of threads with a relatively high yarn count. Such method more over is not designed for high yarn count threads, since the document mentions that conventional fabrics based on fine threads already contain porosities which adversely affect the properties of the final composite.

It thus seemed advantageous to develop a fabric produced from synthetic threads whose yarn count is relatively high with respect to the weight per unit area of the fabric, the fabric having a porosity or a fiber volume ratio compatible with its use in the manufacture of a composite material having satisfactory mechanical properties.

Throughout the specification, the fiber volume ratio (FVR) has a value defined as follows:

$$FVR = \frac{\text{weight of fabric/density of the thread material}}{\text{unit width} \times \text{unit length} \times \text{thickness}}$$

It can be understood that the fiber volume ratio can be calculated at any point in the fabric.

Similarly, throughout the specification "a FVR approximately constant in the fabric" means a FVR whose average value is constant, a local variation of ±3% being acceptable.

SUMMARY OF THE INVENTION

The invention thus relates to a warp and weft fabric based on multifilament technical threads, of which at least 80% by weight of the threads have in combination the following characteristics:

(a)—the yarn count of the threads, for a given weight per unit area of the fabric, is greater than that traditionally used, (b)—the threads do not have a torsion greater than the original torsion of the threads before weaving, which are, in the same proportion, threads with 0 twist/m, (c)—the width of the threads is, over the entire lengths of the threads, greater than or equal to the original width of the threads before weaving. Such threads constitute all the threads in the direction comprising the greater part of the threads by weight when the ratio by weight of the weft threads and the warp threads is greater than or equal to 80/20 and all the threads in the fabric when such ratio is less than 80/20. The fiber volume ratio is approximately constant in the fabric and greater than or equal to that of a traditional fabric based on threads of equal or lower yarn count.

The invention also relates to a warp and weft fabric, based on multifilament technical threads, having in combination the following characteristics:

(a)—the yarn count, for a given weight per unit area of the fabric, is greater than that traditionally used, (b)—the warp and weft threads do not have a torsion greater than the original torsion of the threads before weaving, which are threads with 0 twist/m, (c)—the width of the warp and weft threads is, over the entire lengths of the threads, greater than or equal to the original width of the threads before weaving;

(d)—the fiber volume ratio is approximately constant in the fabric and greater than or equal to that of a traditional fabric based on threads of equal or lower yarn count.

The invention also relates to a fabric such that the proportion by weight of warp (or weft) threads is less than or equal to 20%, such threads constituting the binding weave of a unidirectional weft (or warp) fabric.

The warp and weft fabric according to the invention is also preferably produced from carbon, glass, high density polyethylene, aramid, silicon carbide, or ceramic threads or from mixtures or combinations of such threads.

More particularly, the invention relates to a warp and weft fabric produced from 6K carbon threads, the weight per unit area of the fabric being about 200 g/m$^2$, in particular 193, and with a fiber volume ratio of about 38%, the fabric having been flattened or spread under a pressure of $10^4$ Pa.

The invention also relates to a warp and weft fabric produced from 12K carbon threads, the weight per unit area of the fabric being about 200 g/m$^2$, in particular 193 g/m$^2$, and with a fiber volume ratio greater than or equal to 38%, the fabric having been flattened or spread under a pressure of $10^4$ Pa.

The invention also relates to a warp and weft fabric produced from aramid threads with a yarn count of about 240 tex, the weight per unit area of the fabric being about 180 g/m$^2$, in particular 175 g/m$^2$, and the fiber volume ratio being greater than or equal to 42%, the fabric having been flattened or spread under a pressure of $10^4$ Pa.

The invention in addition relates to a fabric produced from glass threads, 80% by weight of weft (or warp) threads being threads with a yarn count of about 320 tex, the weight per unit area of the fabric being about 120 g/m$^2$ and the fiber volume ratio being greater than or equal to 26%, the fabric having been flattened or spread under a pressure of $10^4$ Pa.

The invention also relates to a method for producing a warp and weft fabric based on multifilament synthetic threads of which at least 80% by weight are threads with 0 twist/m whose yarn count, for a given weight per unit area of the fabric, is greater than that traditionally used, comprising:

—unrolling the threads with 0 twist without introducing torsion,

—weaving the threads in such a way that the width thereof is, over the whole length thereof, greater than or equal to the original width of the threads before weaving, Such untwisted threads being placed in the direction (warp or weft) comprising the greater part of the threads by weight when the ratio by weight of the warp threads and the weft threads is greater than 80/20, such threads comprising all of the threads in the fabric when this ratio is less than 80/20, the fiber volume ratio in the fabric being approximately constant and greater than or equal to that of a traditional fabric based on threads of equal or lower yarn count.

Preferably, when the proportion by weight of the warp (or the weft) threads is less than 20%, the threads are unrolled and woven conventionally.

The method preferably comprises moreover spreading out the threads in the final fabric.

In a first embodiment of the method of the invention, the spreading step is carried out after weaving.

In a second embodiment of the method of the invention, the spreading step is carried out before a subsequent processing of the fabric, such as powdering, preimpregnation or lamination.

In another embodiment, the method also comprises spreading the threads before weaving. This helps to obtain the desired fiber volume ratio in the final fabric.

The invention also relates to a device for spreading the threads in the fabric, in accordance with the production method according to the invention.

According to the invention, the device comprises a vibrator on which is mounted a turning roller, designed to engage the fabric.

The vibrator is preferably a pneumatic vibrator whose frequency is 100 Hertz and operable to generate a pressure of $6\times10^5$ Pa.

BRIEF DESCRIPTION OF THE DRAWINGS

The invention will be better understood and other objects, advantages and characteristics will emerge more clearly from the following description, together with the attached drawings in which.

DETAILED DESCRIPTION OF THE INVENTION

The components in common in the different figures are designated by the same reference numbers.

Figure 1:
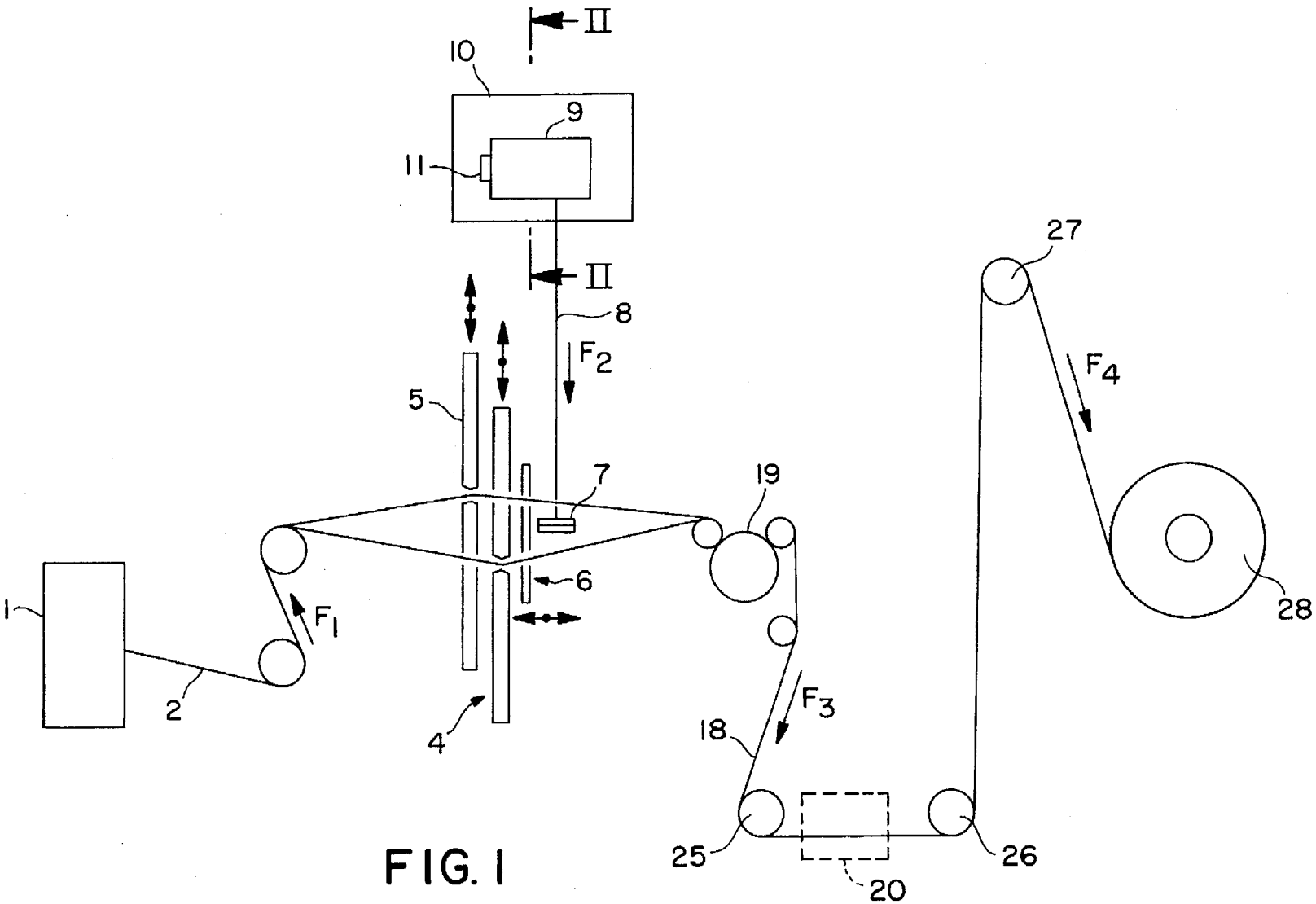
FIG. 1 is a schematic elevation view of an overall installation for obtaining a fabric according to the invention.

Reference should be made to FIG. 1 which illustrates the continuous manufacture of warp and weft fabrics according to the invention.

As shown in FIG. 1, a device 1 feeds a weaving loom 4 with warp threads 2, and is designed to unroll the warp threads without introducing torsion and to impart an appropriate strain thereto. The warp threads 2 thus do not have a torsion greater than the original torsion of the threads.

Preferably, the threads used for both warp and weft do not have any initial torsion. Such threads are termed threads with 0 twist/m or "0 torsion" threads. The purpose of not introducing torsion into the threads will be explained in more detail with respect to the weft threads.

The warp threads 2 are conveyed (arrow F1) towards the weaving loom 4 that is schematically represented and comprises frames 5, a comb 6 and a shuttle 7.

The shuttle 7 introduces, into the warp threads, a weft thread 8 which comes from (arrow F2) a weft bobbin 9 unrolled by a device 10, here called the weft unrolling device.

This device 10 is designed so as not to kink or twist the weft threads. Thus the weft threads 8, inserted by the shuttle 7, do not have a torsion greater than the original torsion of the threads.

Within the scope of the invention, it has been found that, if the weft threads are inserted twisted or with a torsion greater than the original torsion of the threads, it is not possible to obtain a fabric with a high fiber volume ratio. In fact, whatever the type of threads, the width of the thread is smaller than the original width of the threads before weaving, in particular at the twist points, and no treatment after weaving can spread the threads so as to make the fabric closed and thus obtain an appropriate fiber volume ratio.

This observation must be qualified in the case of unidirectional fabrics which will be discussed later.

Weft feeders of the overhead type are conventionally used. This type of device introduces a torsion to the thread since the thread receives one twist for each length of thread equivalent to the perimeter of the bobbin from which it is unrolled.

Figure 2:
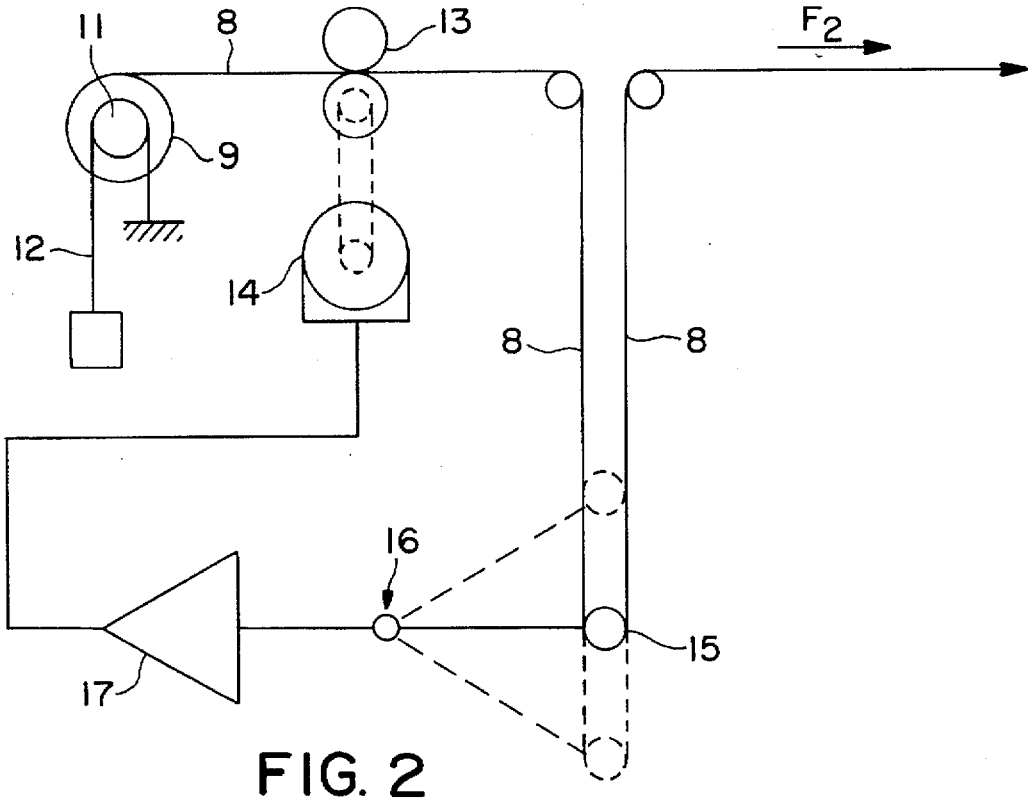
FIG. 2 is a schematic elevation view of a device for unrolling the warp and, is a partial section along line II—II of FIG. 1.

For this reason it is proposed to use, within the scope of the invention, a weft unrolling device of the tangential runout type. In this type of unrolling device, which is also illustrated in FIG. 2, the weft thread 8 is unrolled perpendicularly to the axis 11 of the bobbin 9, a brake 12 being provided for the bobbin 9.

The thread bobbin 9 is unrolled using two pressure rollers 13 which pull the thread by means of a continuous current motor 14. On leaving the rollers, the thread 8 forms a loop whose position is transmitted using a sensor 15 linked to a potentiometer 16 acting on an amplifier 17. This amplifier controls the motor 14 in such a way that the variations in length absorbed by the loom are compensated for by accelerating or decelerating the motor 14.

Identical problems arise for the warp threads, and it is also necessary for such threads to be unrolled by the device 1 without torsion.

Referring again to FIG. 1, the fabric 18 obtained after passage through the loom 4 is directed (arrow F3) into the subsequent manufacturing operations, after having passed over a set of three rollers 19.

The fabric 18 is then optionally conveyed into a spreading device 20. As can be seen below with reference to examples, this spreading device is not always necessary.

Its use can be envisaged in certain cases, after the weaving operation, when the fiber volume ratio is not appropriate. This additional step gives a fiber volume ratio in the fabric which is approximately constant and makes the fabric suitable for use in obtaining composite materials with satisfactory mechanical properties.

Figure 3:
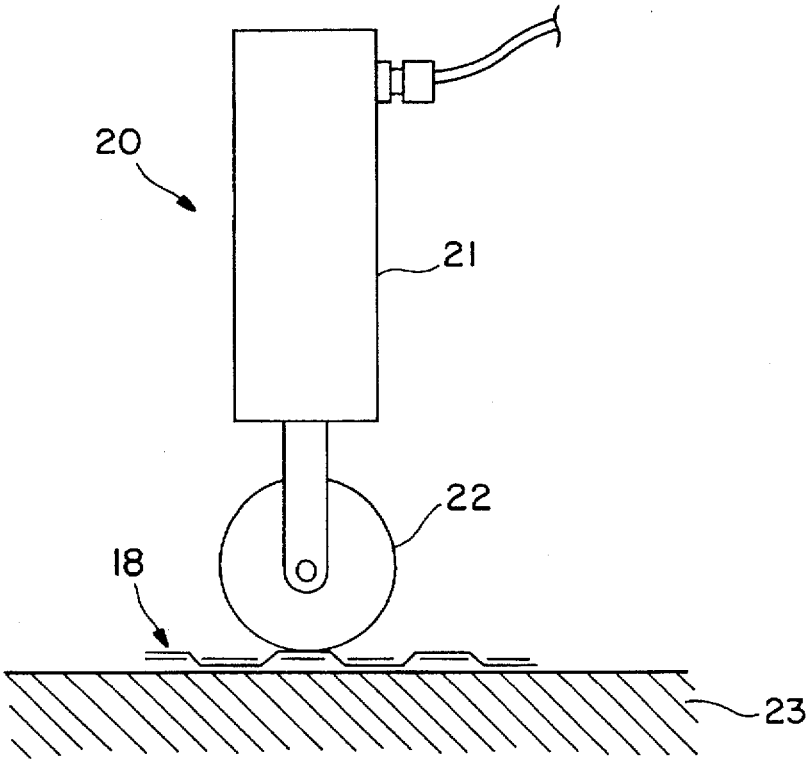
FIG. 3 is a schematic elevation view of a device for spreading the fibers in the fabric.
Figure 4A:
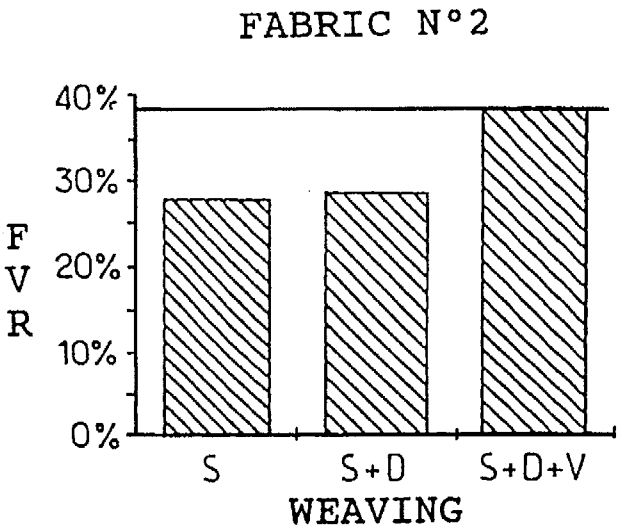
FIGS. 4*a* to 4*d* are histograms showing the fiber volume ratio for a given fabric, obtained by three different production methods.
Figure 4B:
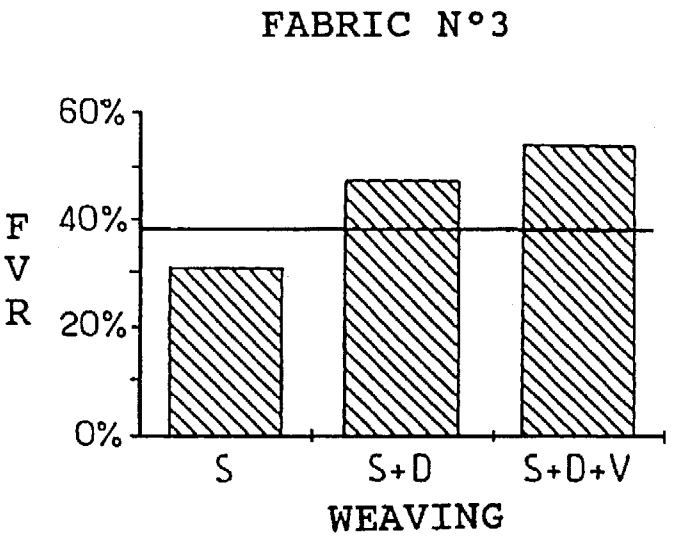
Figure 4C:
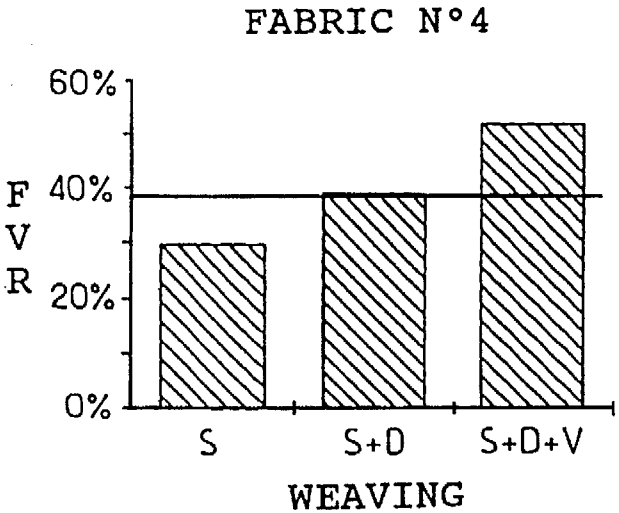
Figure 4D:
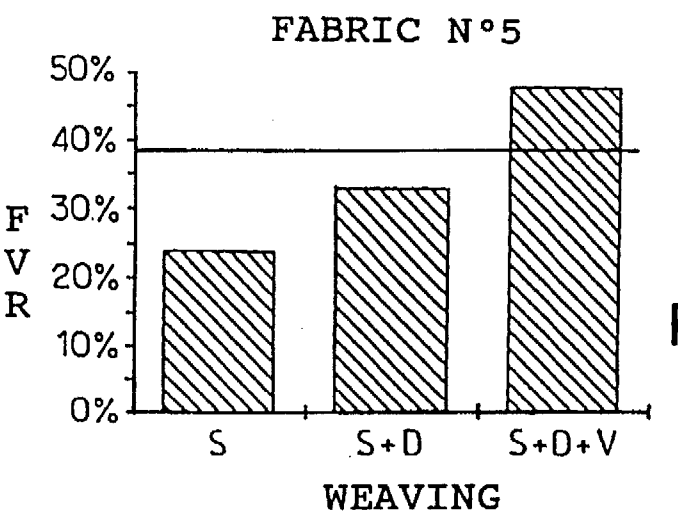

FIG. 3 shows a non-limiting example of an embodiment of such a spreading device 20. It essentially comprises a vibrator 21 on which is mounted a turning roller 22, designed to engage the fabric 18.

Other means than the roller 22 can be envisaged. This could be replaced by another device engaging the fabric 18.

The vibrator 21 is preferably a pneumatic vibrator whose frequency is 100 Hertz and operable to generate under a pressure of $6\times10^5$ Pa on the fabric.

It can be seen that on passing over the fabric 18, the device 20 spreads out the threads in the fabric, via the vibrations transmitted by the roller 22.

Throughout the specification, it should be understood that spreading the threads in the fabric means increasing one dimension of the cross section of the threads in the plane of the fabric, and correspondingly decreasing one dimension of the cross section of the threads in the direction perpendicular to the plane of the fabric.

It may be noted here that the device 20 is only effective when the warp and weft threads do not have torsion greater than the original torsion of the threads before weaving. In fact, if the weft threads, or even some of them, are twisted, spaces will always be present around the twist points, even after passage under the device 20.

This comment must be qualified for unidirectional fabrics which will be described below.

The advantage of this spreading device 20 will be explained in detail below, in particular with reference to FIG. 4.

Other spreading devices could also be envisaged, particularly using ultra-sound, fluid jets or sound waves.

Still referring to FIG. 1, after having been conveyed, via idler rollers 25 and 26, optionally under the device 20, the fabric is directed (arrow F4) via an idler roller 27 to a roller 28 on which it is rolled up.

In this respect it may be emphasized that the spreading step is not necessarily carried out as soon as the fabric is produced, in other words after leaving the loom, after an optional intermediate storage.

In fact, the fabric is not in general used immediately after weaving. It can be stored for a time before a subsequent processing such as powdering, preimpregnation or lamination. It seems advantageous to proceed to the spreading of the fibers in the-fabric just before such processing is carried out.

So as to introduce a better fiber volume ratio in the fabric, a device for spreading the threads before weaving could also be envisaged.

A spreading device could thus be provided before weaving, after weaving or even before and after weaving.

In the above description, the method according to the invention has been applied to all the threads in the fabric, both warp and weft. It could also be applied to a portion only of the threads, in particular to obtain unidirectional fabrics.

Throughout the specification, "unidirectional fabric" means a fabric comprising at least 80% by weight of warp or weft threads.

"Ratio by weight of warp threads and weft threads" also means the ratio warp/weft or weft/warp, the higher ratio being used.

A unidirectional warp fabric is thus a fabric of which 80% by weight of the threads are warp threads, while a unidirectional weft fabric is a fabric of which 80% by weight of the threads are weft threads, these two fabrics having a ratio by weight of warp threads and weft threads greater than or equal to 80/20.

A unidirectional weft fabric will be referred to below. The warp threads of such a fabric in practice constitute binding threads.

In this case, all the weft threads are threads with 0 twist/m, while the warp threads may be of any type.

The device 1 for feeding the loom with warp threads may be a conventional device, optionally introducing torsion to the threads.

However, as before, a device such as device 10 which does not introduce torsion to the threads is used for the weft threads.

The other operations are carried out as before, the fabric 18 being also conveyed into a spreading device if this proves necessary.

It must be emphasized that all the threads placed in the direction comprising the greater part of the threads by weight, in other words the weft threads, are woven in accordance with the method according to the invention. This is necessary in order that the fabrics obtained have a volume ratio greater than or equal to that of a conventional fabric based on threads of equal or lower yarn count, for a given weight per unit area of the fabric.

The method according to the invention can thus be used for only a part of the threads when a unidirectional weft fabric is to be produced. However, in this case, no weft thread can have torsion greater than the original torsion of the threads. In fact, if this is not the case, the width of the thread would be smaller than the original width of the threads before weaving and it would not be possible to obtain a fabric with a high fiber volume ratio. Similarly, the spreading device 20 would not be effective.

It has been observed that, when the fabric has at least 80% of the threads by weight in the weft direction, and these threads are woven according to the method according to the invention, the fabric has a satisfactory fiber volume ratio even if the warp threads are woven in a conventional manner.

The proportion of warp threads may not however exceed 20%. When it is wished to produce a fabric whose ratio of warp threads and weft threads is lower than 80/20, the method according to the invention must be used for all the threads in the fabric, in accordance with the initial description.

These comments may easily be transposed to a unidirectional warp fabric in which all the warp threads are threads with 0 twist/m, while the weft threads may be of any type.

In this case, the device for feeding the loom with weft threads may be a conventional device, and a device such as device 1 which does not introduce torsion to the threads is used for the warp threads.

The advantage of the method which has been described above with reference to FIGS. 1 to 3 will be demonstrated by the following examples.

EXAMPLE 1

For comparative purposes, five balanced fabrics were produced based on carbon threads, with a weight per unit area of 193 g/m$^2$. Conventionally, a "balanced fabric" is a fabric comprising approximately as much warp threads as weft threads. The type of weave used was taffeta. The yarn count of the 12K threads was greater than that of the 6K threads which in turn was greater than that of the 3K threads.

Fabric n°1

High resistance carbon threads TORAYCA FT 300B 3K 40B (catalog reference of the supplier, Toray).

3000 filaments (3K) (Yarn count: 198 tex)

Threads with 0 twist/m

Carbon density: 1.76 g/cm$^3$

Initial width of the thread on the bobbin: 1.74 mm.

Fabric n°2

Carbon threads TORAYCA FT 300B 6K 40B (catalog reference of the supplier, Toray), with the same characteristics as that used for the manufacture of fabric n°1 but comprising 6000 filaments (6K) (Yarn count: 396 tex)

Threads with 0 twist/m

Carbon density: 1.76 g/cm$^3$

Initial width of the thread on the bobbin: 2.1 mm.

Fabric n°3

High resistance carbon threads TORAYCA T700SC 12K 50C (catalog reference of the supplier, Toray).

12 000 filaments (12K) (Yarn count: 800 tex)

Threads with 0 twist/m

Carbon density: 1.8 g/cm$^3$

Initial width of the thread on the bobbin: 6 mm.

Fabric n°4

High resistance carbon threads TORAYCA T300JC 12K 50C (catalog reference of the supplier, Toray).

12 000 filaments (12K) (Yarn count: 800 tex)

Threads with 0 twist/m

Carbon density: 1.78 g/cm$^3$

Initial width of the thread on the bobbin: 5 mm.

Fabric n°5

High resistance carbon threads AKZO Tenax HTA 5131 800 tex F 12 000 (catalog reference of the supplier, Akzo).

12 000 filaments (12K) (Yarn count: 800 tex)

Threads with 0 twist/m

Carbon density: 1.78 g/cm$^3$ initial width of the thread on the bobbin: 3.2 mm.

Three weaving methods were used, in all three of which the warp threads were unrolled without introducing torsion, in particular by using warp unrolling devices of the tangential runout type.

Standard weaving (S)

the weft threads were unrolled by weft feeders of the overhead type, which introduce torsion to the thread.

Weaving with a weft using the tangential run out type (SD)

the weft threads were unwound by weft unrolling devices of the tangential runout type, which do not introduce torsion to the thread.

Weaving a weft using the tangential run out type and vibration (SDV)

This method was as in the previous case except that a vibration system such as that described above with respect to FIG. 3 was used.

Fabric n°1 was produced to be used as a reference for the other fabrics, for the three weaving methods used. It was woven only by standard weaving (S). It is recognized that such a fabric has a fiber volume ratio completely compatible with use in the manufacture of a composite material having satisfactory mechanical properties. The fiber volume ratio of fabric n°1 was 38%.

The results obtained are summarized in tables n°1 to 3 below (the thickness measurements were carried out under a pressure of $10^4$ Pa):

TABLE N°1

STANDARD WEAVING

| | Thread width (mm) | | Thickness | Fiber volume |
|---|---|---|---|---|
| | warp | weft | (mm) | ratio (%) |
| Fabric n°1 | 1.7 | 1.7 | 0.29 | 38 |
| Fabric n°2 | 2.3 | 2.3 | 0.39 | 28 |
| Fabric n°3 | 8 | 3 | 0.35 | 30 |
| Fabric n°4 | 7 | 3 | 0.36 | 30 |
| Fabric n°5 | 5 | 3 | 0.45 | 24 |

TABLE N°2

WEAVING WITH A WEFT USING THE TANGENTIAL RUN OUT TYPE

| | Thread width (mm) | | Thickness | Fiber volume |
|---|---|---|---|---|
| | warp | weft | (mm) | ratio (%) |
| Fabric n°2 | 2.5 | 2.5 | 0.38 | 29 |
| Fabric n°3 | 7 | 6 | 0.23 | 47 |
| Fabric n°4 | 7 | 5.2 | 0.28 | 39 |
| Fabric n°5 | 5.5 | 5 | 0.33 | 33 |

TABLE N°3

WEAVING WITH A WEFT USING THE TANGENTIAL RUN OUT TYPE AND VIBRATION

| | Thread width (mm) | | Thickness | Fiber volume |
|---|---|---|---|---|
| | warp | weft | (mm) | ratio (%) |
| Fabric n°2 | 3 | 3 | 0.29 | 38 |
| Fabric n°3 | 8 | 8 | 0.2 | 54 |
| Fabric n°4 | 7 | 8 | 0.21 | 51 |
| Fabric n°5 | 7 | 7 | 0.23 | 48 |

The above results are also illustrated in the form of histograms in FIGS. 4*a* to 4*d* for each of the fabrics 2 to 4.

In each of the FIGS. 4*a* to 4*d*, on the ordinate shows an, FVR value of 38% which corresponds to the reference fabric n°1.

Fabric n°2

A fiber volume ratio greater than or equal to 38% was obtained with weaving with a weft using the tangential run out type and vibration (SDV). (FVR=38%).

Fabric n°3

A fiber volume ratio greater than or equal to 38% was obtained with weaving with a weft using the tangential run out type (SD). (FVR=47%). The fiber volume ratio was even greater with weaving with a weft using the tangential run out type and vibration (SDV) (FVR=54%).

Fabric n°4

A fiber volume ratio greater than or equal to 38% was also obtained with weaving with a weft using the tangential run out type (FVR=39%). The fiber volume ratio was even greater with weaving with a weft using the tangential run out type and vibration (FVR=51%).

Fabric n°5

A fiber volume ratio greater than or equal to 38% was obtained with weaving with a weft using the tangential run out type and vibration. (FVR=48%).

The invention thus led to the production of a fabric based on 6K threads (Fabric n°2) which had a constant fiber volume ratio in the fabric and which was greater than or equal to that of a fabric based on 3K threads (Fabric n°1) obtained by standard weaving.

It will be noted that when Fabric n°2 was obtained by standard weaving, the fiber volume ratio was much lower than that of Fabric n°1 (FVR=29%). It is thus not suitable for producing a composite material with acceptable mechanical properties.

It is also noteworthy that the width of the warp and weft threads (3 mm) over their entire lengths was greater than or equal to the original width of the threads before weaving (1.74 mm).

In the example of Fabric n°2, an acceptable volume ratio was obtained only with weaving with a weft using the tangential run out type and vibration (SDV). However, such a volume ratio could be also obtained by weaving with a weft using the tangential run out type only, as will be seen from the analysis of the results obtained with Fabrics n°3, 4 and 5.

Fabrics n°3, 4 and 5 are fabrics based on 12K threads. When they were produced by conventional weaving, the fiber volume ratio in the fabric was much lower than that of a fabric based on 3K threads (Fabric n°1) obtained by the same weaving method. Such fabrics were thus not suitable for producing composite materials with acceptable mechanical properties.

However, it can be seen that by using the method according to the invention, it was possible to obtain fabrics based on 12K threads with a fiber volume ratio greater than or equal to that of Fabric n°1.

Such a fiber volume ratio could also be obtained by weaving with a weft using the tangential run out type only (Fabric n°3: FVR=47% and Fabric n°4: FVR=39%) or by weaving with a weft using the tangential run out type and vibration (Fabric n°5: FVR=48%). These fabrics based on 12K threads could thus be used for producing composite materials with satisfactory mechanical properties.

It also will be noted that the width of the warp and weft threads was, over the entire lengths of the threads, greater than or equal to the original width of the threads before weaving (Fabric n°3: 6; 7 or 8 mm and 6 mm; Fabric n°4: 5.2; 7 or 8 mm and 5 mm; Fabric n°5: 7 mm and 3.2 mm).

Figure 5A:
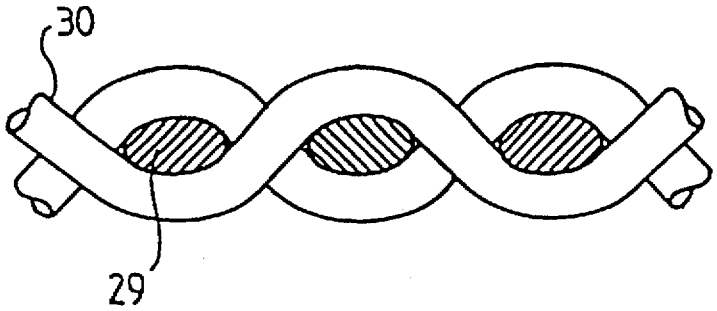
FIGS. 5*a* to 5*c* are enlarged sectional views to illustrate Example 1, FIG. 5*a* showing a warp and weft fabric produced according to standard weaving methods, FIG. 5*b* showing a fabric produced according to a method of weaving with the weft using the tangential run out type and FIG. 5*c* showing a fabric produced by weaving with the weft using the tangential run out type and vibration
Figure 5B:
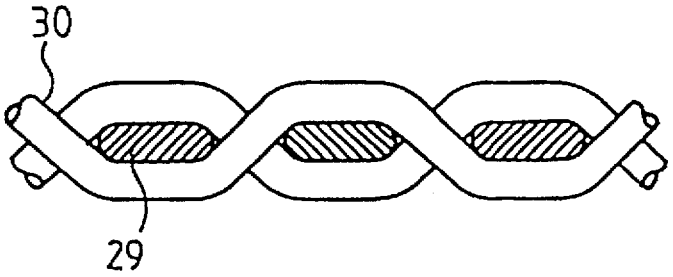
Figure 5C:
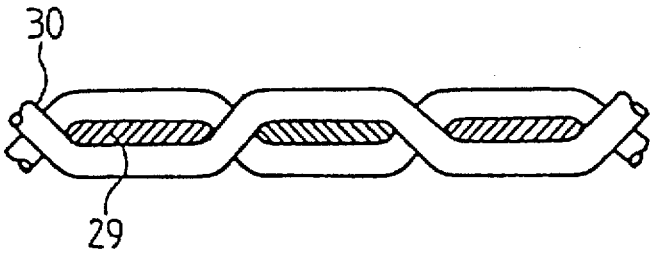

The method according to the invention may be better understood by reference to FIGS. 5*a*–5*b*. FIGS. 5*a*–5*c* illustrates the three types of weaving used (S, SD, SDV).

Reference number 29 for example designates warp threads and reference number 30 weft threads.

After standard weaving (FIG. 5*a*), the fabric had a relatively high thickness, leading to a relatively low fiber volume ratio. The results obtained for Fabrics n°2 to n°5 (cf. FIGS. 4*a*–4*d*) illustrate this.

Weaving with a weft using the tangential run out type (FIG. 5*b*) led to fabrics with a smaller thickness and thus a larger fiber volume ratio. FIGS. 4*a*–4*d* also show this increase in the fiber volume ratio.

Finally, weaving with a weft using the tangential run out type and vibration (FIG. 5*c*) led to a fabric whose thickness was even smaller and with a larger fiber volume ratio. The results appearing in FIGS. 4*a*–4*d* show this.

Figure 6A:
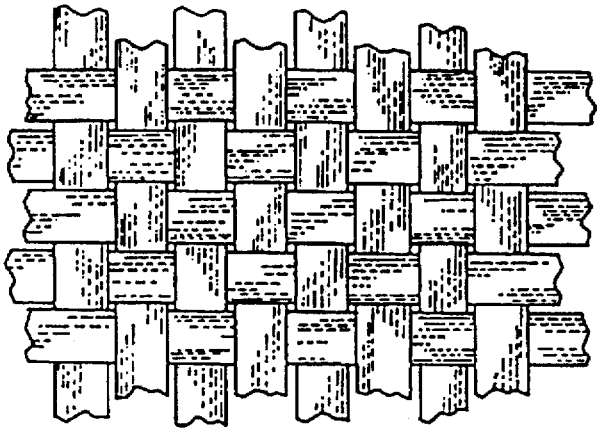
FIGS. 6*a* and 6*b* are enlarged plan views to illustrate Fabric n°4 of Example 1, FIG. 6*a* representing Fabric n°4 after weaving with the weft using the tangential run out type and FIG. 6*b* representing Fabric n°4 after weaving with the weft using the tangential run out type and vibration.
Figure 6B:
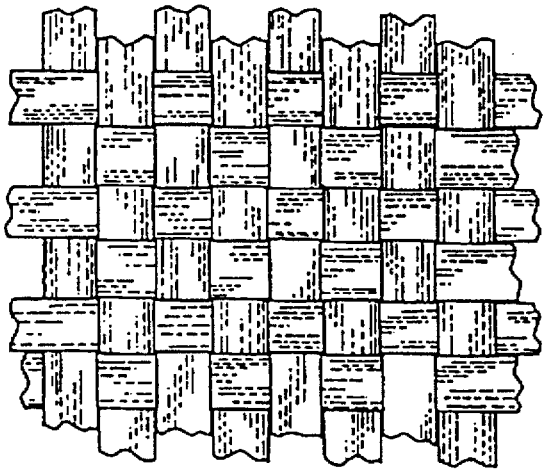

In addition, FIGS. 6*a*–6*b* show a diagram of Fabric n°4 after weaving with a weft using the tangential run out type (FIG. 6*a*) and after weaving with a weft using the tangential run out type and vibration (FIG. 6*b*). In both cases, the fiber volume ratio was higher than that obtained for Fabric n°1 used as a reference. It can also be seen that the interstices between the threads are smaller in FIG. 6*b* than in FIG. 6*a*, the vibration step having led to a spreading of the fibers in the fabric.

EXAMPLE N°2

Two compared fabrics were balanced fabrics, produced from aramid threads: KEVLAR 49 1270 dtex T968 for Fabric n°1 and KEVLAR 49 2400 dtex T968 for Fabric n°2 (Catalog references of Dupont de Nemours) with a weight per unit area of 175 g/m$^2$. The thread density was 1.45 g/cm$^3$ and the threads had 0 twist/m.

Fabric n°1

Yarn count of the threads=127 tex

Initial width of the thread on the bobbin=1.1 mm

Weave=Satin 4

Fabric n°2

Yarn count of the threads=240 tex

Initial width of the thread on the bobbin=1.8 mm

Weave=Taffeta

As for example n°1, three weaving methods were used: standard weaving (S), weaving with a weft using the tangential run out type (SD) and weaving with a weft using the tangential run out type and vibration (SDV).

Fabric n°1 is used as a reference for fabric n°2, for the three weaving methods used. Fabric n°1 was only woven by standard weaving (S). This fabric had a fiber volume ratio completely compatible with its use in the production of a composite material having satisfactory mechanical properties. The fiber volume ratio of fabric n°1 was 42%.

The results obtained are summarized in tables n°4 to 6 (thickness measurements were carried out under a pressure of 10$^4$ bar):

TABLE N°4

STANDARD WEAVING

| | Thread width (mm) | | Thickness | Fiber volume |
|---|---|---|---|---|
| | warp | weft | (mm) | ratio (%) |
| Fabric n°1 | 1.2 | 1.3 | 0.29 | 42 |
| Fabric n°2 | 2.3 | 2.3 | 0.32 | 38 |

TABLE N°5

WEAVING WITH A WEFT USING THE TANGENTIAL RUN OUT TYPE

| | Thread width (mm) | | Thickness | Fiber volume |
|---|---|---|---|---|
| | warp | weft | (mm) | ratio (%) |
| Fabric n°2 | 2.4 | 2.3 | 0.31 | 39 |

TABLE N°6

WEAVING WITH A WEFT USING THE TANGENTIAL RUN OUT TYPE AND VIBRATION

| | Thread width (mm) | | Thickness | Fiber volume |
|---|---|---|---|---|
| | warp | weft | (mm) | ratio (%) |
| Fabric n°2 | 3 | 3 | 0.27 | 45 |

It can be seen that for Fabric n°2, a fiber volume ratio greater than or equal to 42% was obtained with weaving with a weft using the tangential run out type and vibration (SDV) (FVR=45%). This fabric would thus be completely suitable for producing a composite material with satisfactory mechanical properties.

However, when Fabric n°2 was woven using standard weaving (S), the fiber volume ratio was 38%, i.e. lower than that of Fabric n°1. This fabric was therefore not suitable for producing a composite material with satisfactory mechanical properties.

It is thus shown that the method according to the invention enables a fabric produced from threads with a higher yarn count than that of Fabric n°1, to have while having a constant fiber volume ratio greater than that of Fabric n°1.

It will also be noted that the width of the warp and weft threads was, over the entire lengths of the threads, greater than or equal to the original width of the threads before weaving.

FIGS. 5*a*–5*c* also illustrate this example of the embodiment of the invention.

EXAMPLE N°3

Two fabrics in this example were unidirectional fabrics, produced from glass threads, with a weight per unit area of 120 g/m$^2$. The weave used was taffeta.

The distribution by weight of the threads was as follows: 80% weft and 20% warp, for both fabrics. These fabrics thus have the shape of a unidirectional web, the warp threads acting as binding threads. This example more particularly represents a unidirectional weft fabric.

Fabric n°1

Warp material: glass threads EC9 34×2 S150 1383, thread density=2.54

Weft material: glass threads: ROVING 160 tex (Cosmostrand 160 tex)

Yarn count of the threads=160 tex

Initial width of the threads on the bobbin=0.9 mm

Threads with 0 twist/m

Fabric n°2

Warp material: glass threads with the same characteristics as the warp threads of Fabric n°1

Weft material: glass threads: ROVING 320 tex (RO99 320 TEX L 177)

Yarn count of the threads=320 tex

Initial width of the thread on the bobbin=2.4 mm

Threads with 0 twist/m

As for examples n°1 and 2, three weaving methods were used: standard weaving (S), weaving with a weft using the tangential run out type (SD) and weaving with a weft using the tangential run out type and vibration (SDV).

In accordance with the preceding description, the method according to the invention was applied only to the weft threads, the warp threads being woven conventionally.

Fabric n°1 is used as a reference for fabric n°2, for the three weaving methods used. Fabric n°1 was only woven by standard weaving (S). It had a fiber volume ratio compatible with its use in the production of a composite material having satisfactory mechanical properties. The fiber volume ratio of fabric n°1 was 26%.

The results obtained are summarized in tables n°7 to 9 (thickness measurements were carried out under a pressure of $10^4$ bar):

TABLE N°7

| STANDARD WEAVING | Weft thread width (mm) | Thickness (mm) | Fiber volume ratio (%) |
|---|---|---|---|
| Fabric n°1 | 0.9 | 0.18 | 26 |
| Fabric n°2 | 2.07 | 0.23 | 20.5 |

TABLE N°8

| WEAVING WITH A WEFT USING THE TANGENTIAL RUN OUT TYPE | Weft thread width (mm) | Thickness (mm) | Fiber volume ratio (%) |
|---|---|---|---|
| Fabric n°2 | 2.4 | 0.22 | 21.5 |

TABLE N°9

| WEAVING WITH A WEFT USING THE TANGENTIAL RUN OUT TYPE AND VIBRATION | Weft thread width (mm) | Thickness (mm) | Fiber volume ratio (%) |
|---|---|---|---|
| Fabric n°2 | 3 | 0.17 | 28 |

Thus, for Fabric n°2, a fiber volume ratio greater than 26% was obtained with weaving with a weft using the tangential run out type and vibration (SDV) (FVR=28%). Such a fabric would thus be completely suitable for producing a composite material with satisfactory mechanical properties.

Fabric n°2 was not suitable for such an application when it was produced using standard weaving (S), the fiber volume ratio being much lower than that of Fabric n°1 (20.5%).

The method according to the invention thus provides a fabric produced from threads which, in the proportion of 80% by weight corresponding to the weft threads, had a higher yarn count than that of the weft threads of Fabric n°1, this fabric having a constant fiber volume ratio in the fabric and greater than that of Fabric n°1.

It also will be noted that, over the entire lengths of the threads, the width of the weft threads was greater than or equal to the original width of the threads before weaving.

These examples demonstrate the advantages of the method according to the invention. The use of novel weaving methods enables threads with a relatively high yarn count to be used for a relatively low weight per unit area, while at the same time having an appropriate fiber volume ratio.

Such properties are particularly obtained by the fact that the warp and/or weft threads are used in such a way that their torsion in the fabric is no greater than their original torsion. When the device for spreading the threads in the fabric is necessary, the absence of additional torsion enables it to be fully effective and to give maximum spreading of the fibers to obtain a closed fabric.

We claim:

1. A fabric woven of multifilament warp and weft threads and suitable for use in a composite material, said fabric comprising:

said warp threads having a total weight less than 80% of the weight of said fabric, and said weft threads having a total weight less than 80% of said weight of said fabric;

said woven warp and weft threads having 0 twist/m and a torsion no greater than an original torsion of said threads before weaving thereof;

each said woven warp and weft thread having a width over the entire length thereof that is greater than or equal to an original width thereof before weaving thereof;

said fabric having a given weight per unit area and a fiber volume ratio that is approximately constant throughout said fabric and that is satisfactory for use in a composite material; and said warp and weft threads being of a yarn count of 1K, and said given weight per unit area being less than a range of between 90 and 210 g/m$^2$.

2. A fabric as claimed in claim 1, wherein said warp and weft threads comprise carbon threads.

3. A fabric as claimed in claim 1, wherein said fabric comprises a balanced fabric with said total weight of said warp threads being substantially equal to said total weight of said weft threads.

4. A fabric as claimed in claim 1, wherein said warp and weft threads comprise threads selected from the group consisting of carbon threads, glass threads, high density polyethylene threads, aramid threads, silicon carbide threads, and ceramic threads, or from mixtures or combinations of such threads.

5. A method for producing a woven fabric of warp and weft threads and that is suitable for use in a composite material, said method comprising:

unrolling said warp and weft threads with 0 twist/m therein and without introducing torsion therein;

conducting a weaving operation to weave the thus unrolled warp and weft threads into said woven fabric to ensure that:

said warp threads have a total weight less than 80% of the weight of the fabric, and said weft threads have a total weight less than 80% of said weight of said fabric;

a width of each said warp and weft thread over the entire length thereof after weaving thereof is no less than an original width thereof before weaving thereof; and said woven fabric has a given weight per unit area and a fiber volume ratio that is approximately constant throughout said fabric and that is satisfactory for use in a composite material; and selecting said warp and weft threads to be of a yarn count of 1 k and with said given weight per unit area being less than a range between 90 and 210 g/m$^2$.

6. A method as claimed in claim 5, further comprising spreading and flattening said threads.

7. A method as claimed in claim 6, comprising conducting said spreading and flattening on said fabric after said weaving operation.

8. A method as claimed in claim 6, comprising conducting said spreading and flattening prior to any processing of said fabric subsequent to said weaving operation.

9. A method as claimed in claim 6, wherein said width of said each warp and weft thread after said spreading and flattening is greater than said original width thereof.

10. A method as claimed in claim 6, comprising conducting said spreading and flattening before said weaving operation.

11. A method as claimed in claim 6, comprising pressing said threads under a pressure of at least $10^4$ Pa.

12. A method as claimed in claim 11, comprising conducting said pressing by a roller engaging said fabric and vibrated by a vibrator.

13. A method as claimed in claim 12, comprising vibrating said vibrator at a frequency of 100 Hertz, and pressing said roller on said fabric at a pressure of $6\times10^5$ Pa.

14. A method as claimed in claim 5, wherein said warp and weft threads comprise carbon threads.

15. A fabric as claimed in claim 5, wherein said fabric comprises a balanced fabric with said total weight of said warp threads being substantially equal to said total weight of said weft threads.

16. A fabric as claimed in claim 5, wherein said warp and weft threads comprise threads selected from the group consisting of carbon threads, glass threads, high density polyethylene threads, aramid threads, silicon carbide threads, and ceramic threads, or from mixtures or combinations of such threads.

17. A fabric woven of multifilament warp and weft threads and suitable for use in a composite material, said fabric comprising:

said warp threads having a total weight less than 80% of the weight of said fabric, and said weft threads having a total weight less than 80% of said weight of said fabric;

said woven warp and weft threads having 0 twist/m and a torsion no greater than an original torsion of said threads before weaving thereof;

each said woven warp and weft thread having a width over the entire length thereof that is greater than or equal to an original width thereof before weaving thereof;

said fabric having a given weight per unit area and a fiber volume ratio that is approximately constant throughout said fabric and that is satisfactory for use in a composite material; and said warp and weft threads being of a yarn count of 6K, and said given weight per unit area being less than a range of between 260 and 600 g/m$^2$.

18. A fabric as claimed in claim 17, wherein said warp and weft threads comprise carbon threads.

19. A fabric as claimed in claim 17, wherein said weight per unit area is about 200 g/m$^2$, and said fiber volume ratio is greater than or equal to 38%.

20. A fabric as claimed in claim 17, wherein said fabric comprises a balanced fabric with said total weight of said warp threads being substantially equal to said total weight of said weft threads.

21. A fabric as claimed in claim 17, wherein said warp and weft threads comprise threads selected from the group consisting of carbon threads, glass threads, high density polyethylene threads, aramid threads, silicon carbide threads, and ceramic threads, or from mixtures or combinations of such threads.

22. A fabric woven of multifilament warp and weft threads and suitable for use in a composite material, said fabric comprising:

said warp threads having a total weight less than 80% of the weight of said fabric, and said weft threads having a total weight less than 80% of said weight of said fabric;

said woven warp and weft threads having 0 twist/m and a torsion no greater than an original torsion of said threads before weaving thereof;

each said woven warp and weft thread having a width over the entire length thereof that is greater than or equal to an original width thereof before weaving thereof;

said fabric having a given weight per unit area and a fiber volume ratio that is approximately constant throughout said fabric and that is satisfactory for use in a composite material; and said warp and weft threads being of a yarn count of 12K, and said given weight per unit area being less than a range of between 465 and 800 g/m$^2$.

23. A fabric as claimed in claim 22, wherein said warp and weft threads comprise carbon threads.

24. A fabric as claimed in claim 22, wherein said weight per unit area is about 200 g/m$^2$, and said fiber volume ratio is greater than or equal to 38%.

25. A fabric as claimed in claim 22, wherein said fabric comprises a balanced fabric with said total weight of said warp threads being substantially equal to said total weight of said weft threads.

26. A fabric as claimed in claim 22, wherein said warp and weft threads comprise threads selected from the group consisting of carbon threads, glass threads, high density polyethylene threads, aramid threads, silicon carbide threads, and ceramic threads, or from mixtures or combinations of such threads.

27. A fabric woven of multifilament warp and weft threads and suitable for use in a composite material, said fabric comprising:

said warp threads having a total weight less than 80% of the weight of said fabric, and said weft threads having a total weight less than 80% of said weight of said fabric;

said woven warp and weft threads having 0 twist/m and a torsion no greater than an original torsion of said threads before weaving thereof;

each said woven warp and weft thread having a width over the entire length thereof that is greater than or equal to an original width thereof before weaving thereof;

said fabric having a given weight per unit area and a fiber volume ratio that is approximately constant throughout said fabric and that is satisfactory for use in a composite material; and said warp and weft threads comprising aramid threads having a yarn count of about 240 tex, said given weight per unit area being about 180 g/m$^2$, and said fiber volume ratio being greater than or equal to 42%.

28. A fabric as claimed in claim 27, wherein said fabric comprises a balanced fabric with said total weight of said warp threads being substantially equal to said total weight of said weft threads.

29. A method for producing a woven fabric of warp and weft threads and that is suitable for use in a composite material, said method comprising:

unrolling said warp and weft threads with 0 twist/m therein and without introducing torsion therein;

conducting a weaving operation to weave the thus unrolled warp and weft threads into said woven fabric to ensure that:

said warp threads have a total weight lees than 80% of the weight of the fabric, and said weft threads have a total weight less than 80% of said weight of said fabric;

a width of each said warp and weft thread over the entire length thereof after weaving thereof is no less than an original width thereof before weaving thereof; and said woven fabric has a given weight per unit area and a fiber volume ratio that is approximately constant throughout said fabric and that is satisfactory for use in a composite material; and selecting said warp and weft threads to be of a yarn count of 6K, and said given weight per unit area is less than a range of between 260 and 600 g/m$^2$.

30. A method as claimed in claim 29, further comprising spreading and flattening said threads.

31. A method as claimed in claim 30, comprising conducting said spreading and flattening on said fabric after said weaving operation.

32. A method as claimed in claim 30, comprising conducting said spreading and flattening prior to any processing of said fabric subsequent to said weaving operation.

33. A method as claimed in claim 30, wherein said width of said each warp and weft thread after said spreading and flattening is greater than said original width thereof.

34. A method as claimed in claim 30, comprising conducting said spreading and flattening before said weaving operation.

35. A method as claimed in claim 30, comprising pressing said threads under a pressure of at least $10^4$ Pa.

36. A method as claimed in claim 35, comprising conducting said pressing by a roller engaging said fabric and vibrated by a vibrator.

37. A method as claimed in claim 36, comprising vibrating said vibrator at a frequency of 100 Hertz, and pressing said roller on said fabric at a pressure of $6\times10^5$ Pa.

38. A method as claimed in claim 29, wherein said warp and weft threads comprise carbon threads.

39. A method as claimed in claim 29, wherein said weight per unit area is about 200 g/m$^2$, and said fiber volume ratio is greater than or equal to 38%.

40. A fabric as claimed in claim 29, wherein said fabric comprises a balanced fabric with said total weight of said warp threads being substantially equal to said total weight of said weft threads.

41. A fabric as claimed in claim 29, wherein said warp and weft threads comprise threads selected from the group consisting of carbon threads, glass threads, high density polyethylene threads, aramid threads, silicon carbide threads, and ceramic threads, or from mixtures or combinations of such threads.

42. A method for producing a woven fabric of warp and weft threads and that is suitable for use in a composite material, said method comprising:

unrolling said warp and weft threads with 0 twist/m therein and without introducing torsion therein;

conducting a weaving operation to weave the thus unrolled warp and weft threads into said woven fabric to ensure that:

said warp threads have a total weight less than 80% of the weight of the fabric, and said weft threads have a total weight less than 80% of said weight of said fabric;

a width of each said warp and weft thread over the entire length thereof after weaving thereof is no less than an original width thereof before weaving thereof; and said woven fabric has a given weight per unit area and a fiber volume ratio that is approximately constant throughout said fabric and that is satisfactory for use in a composite material; and selecting said warp and weft threads to be of a yarn count of 12K, and said given weight per unit area is less than a range of between 465 and 800 g/m$^2$.

43. A method as claimed in claim 42, further comprising spreading and flattening said threads.

44. A method as claimed in claim 43, comprising conducting said spreading and flattening on said fabric after said weaving operation.

45. A method as claimed in claim 43, comprising conducting said spreading and flattening prior to any processing of said fabric subsequent to said weaving operation.

46. A method as claimed in claim 43, wherein said width of said each warp and weft thread after said spreading and flattening is greater than said original width thereof.

47. A method as claimed in claim 43, comprising conducting said spreading and flattening before said weaving operation.

48. A method as claimed in claim 43, comprising pressing said threads under a pressure of at least $10^4$ Pa.

49. A method as claimed in claim 48, comprising conducting said pressing by a roller engaging said fabric and vibrated by a vibrator.

50. A method as claimed in claim 49, comprising vibrating said vibrator at a frequency of 100 Hertz, and pressing said roller on said fabric at a pressure of $6\times10^5$ Pa.

51. A method as claimed in claim 42, wherein said warp and weft threads comprise carbon threads.

52. A fabric as claimed in claim 42, wherein said weight per unit area is about 200 g/m$^2$, and said fiber volume ratio is greater than or equal to 38%.

53. A fabric as claimed in claim 42, wherein said fabric comprises a balanced fabric with said total weight of said warp threads being substantially equal to said total weight of said weft threads.

54. A fabric as claimed in claim 42, wherein said warp and weft threads comprise threads selected from the group consisting of carbon threads, glass threads, high density polyethylene threads, aramid threads, silicon carbide threads, and ceramic threads, or from mixtures or combinations of such threads.

55. A method for producing a woven fabric of warp and weft threads and that is suitable for use in a composite material, said method comprising:

unrolling said warp and weft threads with 0 twist/m therein and without introducing torsion therein:

conducting a weaving operation to weave the thus unrolled warp and weft threads into said woven fabric to ensure that:

said warp threads have a total weight less than 80% of the weight of the fabric, and said weft threads have a total weight less than 80% of said weight of said fabric;

a width of each said warp and weft thread over the entire length thereof after weaving thereof is no less than an original width thereof before weaving thereof; and said woven fabric has a given weight per unit area and a fiber volume ratio that is approximately constant throughout said fabric and that is satisfactory for use in a composite material; and selecting said warp and weft threads to comprise aramid threads having a yarn count of about 240 tex, said given weight per unit area is about 180 g/m$^2$, and said fiber volume ratio is greater than or equal to 42%.

56. A method as claimed in claim 55, further comprising spreading and flattening said threads.

57. A method as claimed in claim 56, comprising conducting said spreading and flattening on said fabric after said weaving operation.

58. A method as claimed in claim 56, comprising conducting said spreading and flattening prior to any processing of said fabric subsequent to said weaving operation.

59. A method as claimed in claim 56, wherein said width of said each warp and weft thread after said spreading and flattening is greater than said original width thereof.

60. A method as claimed in claim 56, comprising conducting said spreading and flattening before said weaving operation.

61. A method as claimed in claim 56, comprising pressing said threads under a pressure of at least $10^4$ Pa.

62. A method as claimed in claim 61, comprising conducting said pressing by a roller engaging said fabric and vibrated by a vibrator.

63. A method as claimed in claim 62, comprising vibrating said vibrator at a frequency of 100 Hertz, and pressing said roller on said fabric at a pressure of $6\times10^5$ Pa.

64. A fabric as claimed in claim 55, wherein said fabric comprises a balanced fabric with said total weight of said warp threads being substantially equal to said total weight of said weft threads.

* * * * *

UNITED STATES PATENT AND TRADEMARK OFFICE

CERTIFICATE OF CORRECTION

PATENT NO. : 5,732,748

DATED : March 31, 1998

INVENTOR(S) : Jean AUCAGNE et al.

It is certified that error appears in the above-identified patent and that said Letters Patent is hereby corrected as shown below:

Claim 5, line 22, change "1 k" to --1K--.

Claim 15, line 1, change "fabric" to --method--.

Claim 16, line 1, change "fabric" to --method--.

Claim 40, line 1, change "fabric" to --method--.

Claim 41, line 1, change "fabric" to --method--.

Claim 52, line 1, change "fabric" to --method--.

Claim 53, line 1, change "fabric" to --method--.

Claim 54, line 1, change "fabric" to --method--.

Claim 64, line 1, change "fabric" to --method--.

Signed and Sealed this

Eighteenth Day of August, 1998

Bruce Lehman

*Attest:*

BRUCE LEHMAN

*Attesting Officer*

*Commissioner of Patents and Trademarks*